US011775000B2

(12) United States Patent
Hafkemeyer

(10) Patent No.: US 11,775,000 B2
(45) Date of Patent: Oct. 3, 2023

(54) CIRCUIT WITH SELECTIVELY IMPLEMENTABLE CURRENT MIRROR CIRCUITRY

(71) Applicant: NXP B.V., Eindhoven (NL)

(72) Inventor: Kristian Hafkemeyer, Hamburg (DE)

(73) Assignee: NXP B.V., Eindhoven (NL)

( * ) Notice: Subject to any disclaimer, the term of this patent is extended or adjusted under 35 U.S.C. 154(b) by 108 days.

(21) Appl. No.: 17/354,484

(22) Filed: Jun. 22, 2021

(65) Prior Publication Data

US 2022/0404854 A1 Dec. 22, 2022

(51) Int. Cl.
*G05F 3/26* (2006.01)

(52) U.S. Cl.
CPC ..... *G05F 3/262* (2013.01)

(58) Field of Classification Search
CPC ..... G05F 3/262
See application file for complete search history.

(56) References Cited

U.S. PATENT DOCUMENTS

| | | | | |
|---|---|---|---|---|
| 4,408,190 | A | 10/1983 | Nagano | |
| 4,594,577 | A | 6/1986 | Mao | |
| 4,608,530 | A | 8/1986 | Bacrania | |
| 5,254,993 | A | 10/1993 | Wolber et al. | |
| 5,844,511 | A | 12/1998 | Izumakawa | |
| 10,693,477 | B1 * | 6/2020 | Marcu | H03L 7/099 |
| 2005/0077957 | A1 * | 4/2005 | Kasai | G09G 3/3688 330/9 |
| 2006/0238235 | A1 * | 10/2006 | Wey | G05F 3/265 327/543 |
| 2012/0007660 | A1 * | 1/2012 | Hummerston | G11C 5/147 327/530 |
| 2012/0049817 | A1 * | 3/2012 | Willey | G05F 3/20 323/282 |
| 2021/0271281 | A1 * | 9/2021 | Baorda | G05F 3/262 |

OTHER PUBLICATIONS

Al-Tamimi, K., "CMOS Logarithmic Current Generator", 2012 IEEE Student Conference on Research and Development, Dec. 5-6, 2012.

Bonteanu, G., "A high-gain programmable current mirror for large bias currents generation", 2017 5th International Symposium on Electrical and Electronics Engineering (ISEEE), Oct. 20-22, 2017.

Gu, M., "Design of a Programmable Gain, Temperature Compensated Current-Input Current-Output CMOS Logarithmic Amplifier", IEEE Transactions on Biomedical Circuits and Systems, vol. 8, No. 3, Jun. 2014.

Lu, C., "A fast and sensitive built-in current sensor for IDDQ testing", Digest of Papers 1996 IEEE International Workshop on IDDQ Testing, Oct. 24-25, 1996.

Wolffenbuttel, R., "Digitally Programmable Accurate Current Sources for Logarithmic Control of the Amplification or Attenuation in a Gain Cell", IEEE Journal of Solid-State Circuits, vol. 23, No. 3, Jun. 1988.

* cited by examiner

*Primary Examiner* — Sisay G Tiku
(74) *Attorney, Agent, or Firm* — David G. Dolezal

(57) ABSTRACT

A circuit includes a current mirror stage with a switch, that when made conductive, provides current between the input and the output of the current mirror stage through the switch. When the switch is nonconductive, current is not provided through the switch. The stage includes current mirror circuitry, that when the switch is nonconductive, provides current at the output that is mirrored from current provided to the input of the current mirror stage.

19 Claims, 4 Drawing Sheets

| RANGE1 | RANGE2 | RANGE3 | CURRENT SCALE |
|---|---|---|---|
| 0 | 0 | 0 | 1 x IREF |
| 1 | 0 | 0 | 10 x IREF |
| 1 | 1 | 0 | 100 x IREF |
| 1 | 1 | 1 | 1000 x IREF |

FIG. 3

CIRCUIT WITH SELECTIVELY IMPLEMENTABLE CURRENT MIRROR CIRCUITRY

BACKGROUND OF THE INVENTION

Field of the Invention

This invention relates to a circuit with current mirror circuitry.

Background

Current mirrors can be utilized to provide an output current that is of a multiple of the input current.

BRIEF DESCRIPTION OF THE DRAWINGS

The present invention may be better understood, and its numerous objects, features, and advantages made apparent to those skilled in the art by referencing the accompanying drawings.

FIG. 3 is a table showing possible current multiplication values by a current generation circuit according to one embodiment of the present invention.

The use of the same reference symbols in different drawings indicates identical items unless otherwise noted. The Figures are not necessarily drawn to scale.

DETAILED DESCRIPTION

The following sets forth a detailed description of a mode for carrying out the invention. The description is intended to be illustrative of the invention and should not be taken to be limiting.

As disclosed herein, a current generation circuit includes one or more current mirror stages, each with a switch, that when made conductive, provides current between the input and the output of the current mirror stage through the switch. When the switch is nonconductive, current is not provided through the switch. Each stage includes current mirror circuitry, that when the switch is nonconductive, provides current at the output that is mirrored from current provided to the input of the current mirror stage. In some embodiments, the current mirror stages can be daisy chained together to selectively multiply the current from the previous stage. In some embodiments, by controlling the switches, the amount of current provided by the current generation circuit can be selectively varied. In some embodiments, the current generation circuit can be utilized in a test circuit for testing circuit devices. In some embodiments with multiple current stages, the current can be selectively multiplied on a logarithmic scale.

In one embodiment, utilizing a current generation circuit with current mirror stages each having a switch that is selectively made conductive to provide current from the input to the output may allow for a current generation circuit to provide a variable amount current with a reduced number of enabled current paths when a lessor amount of current is being provided by the current generation circuit. Accordingly, such a circuit may be able to consume less power during operation such as during testing operations when the amount of current is varied over the test.

Figure 1:
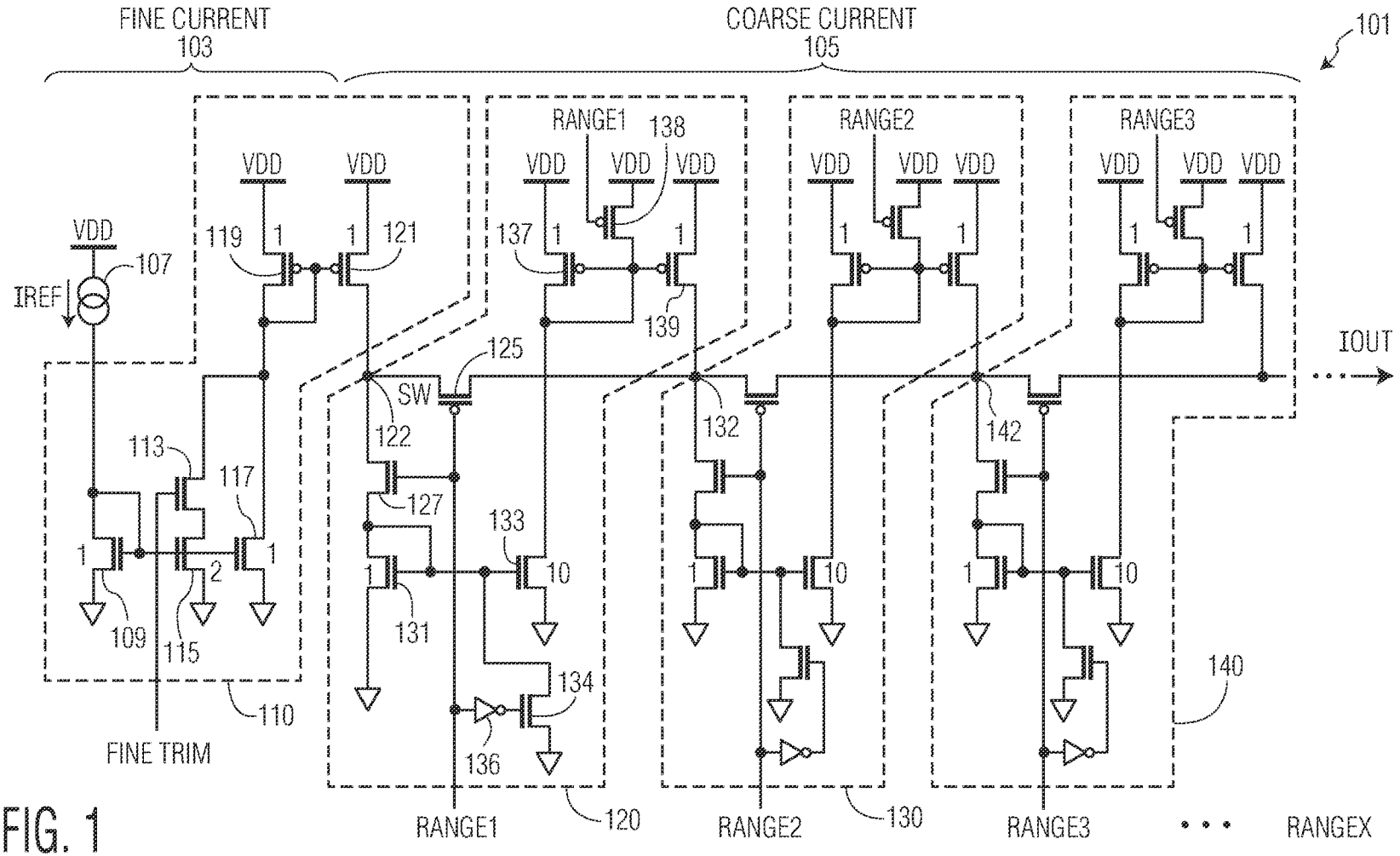
FIG. 1 is a circuit diagram of a current generation circuit according to one embodiment of the present invention.

FIG. 1 is a current generation circuit 101 according to one embodiment of the present invention. In the embodiment shown, circuit 101 includes a fine current control portion 103 and a coarse current control portion 105. The fine control portion 103 includes and initial current mirror stage 110 and a current source 107 for providing a reference current IREF to an input of the initial current mirror stage 110. Initial current stage 110 includes current mirror circuitry with NFETs 109 and 117 in a current mirror configuration and PFETs 119 and 121 is a current mirror configuration. In the current mirror configuration, current (IREF) flowing through transistor 109 generates a voltage at the gate of transistor 109 and transistor 117 such that the currents flowing through both transistors 109 and 117 are proportional. If transistors 109 and 117 are the same size (e.g. with the same width/length ratios for FETs) as designated by the "1" next to both transistors 109 and 117 in FIG. 1, then the current (IREF) through both transistors 109 and 117 will be the same (as designated by the "1" next to both transistors 109 and 117 in FIG. 1).

The current set through transistor 117 controls the current through transistor 119, which sets the voltage at the gates of transistors 119 and 121 such that the currents through both transistors are proportional. In the embodiment shown, transistors 119 and 121 are of the same size such that the current provided by transistor 121 at node 122 is the same as the current provided through transistor 119 (as designated by the "1"s next to transistors 119 and 121). Accordingly, the current at node 122 is IREF due to both transistors 109 and 117 being of the same size and transistors 119 and 121 being of the same size.

In the embodiment shown, stage 110 includes a trim circuit which includes transistors 113 and 115 to adjust the ratio of the input current (IREF) received at the drain of transistor 109 to the output current provided at node 122 of stage 110. In the embodiment shown, when transistor 113 is made conductive by the assertion of the "FINE TRIM" signal, transistor 115, being in a current mirror configuration with transistor 109, will conduct an amount of current that is proportional to IREF to increase the amount of current pulled through transistor 119, which increases the amount of current through transistor 121 to node 122. In the embodiment shown, transistor 115 is of a size that will conduct twice the amount of current as transistors 109 and 117 (as designated by the "2" next to transistor 115). Accordingly, when the FINE TRIM signal is asserted, node 122 provides current in an amount of 3× IREF as opposed to IREF when the FINE TRIM signal is not asserted.

In the above paragraph, the FINE TRIM signal is described as being a "digital" signal where its either asserted to provide a current of 3×IREF at node 122 or non asserted to provide a current of IREF at node 122. However, in other embodiments, the FINE TRIM signal may be an analog control signal where the amount of current through transistor 113 and transistor 115 is dependent on the particular voltage of the FINE TRIM signal. With such a system, the amount of current that is provided at node 122 can be adjusted by varying the voltage of the FINE TRIM signal. In other embodiments, current source 107 would be adjustable to vary IREF for fine tuning of a signal. In other embodiments, stage 110 would include multiple trim paths (not shown), where each trim path could be selectively enabled to vary the current at node 122 by a different amount. In still other embodiments, stage 110 would not include a trim path. In some embodiments, the fine control portion 103 may be located after the coarse control portion 105.

In the embodiment shown, the coarse control portion 105 includes multiple current mirror stages (with stages 120, 130, and 140 shown in FIG. 1) for selectively multiplying the amount of current flowing through node 122 (IREF or 3× IREF depending upon the assertion of the FINE TRIM signal). The input of stage 120 is connected to node 122. The input of stage 130 is connected to the output of stage 120 (at node 132), and the input of stage 140 is connected to the output of stage 130 (at node 142).

Stage 120 includes current mirror circuitry of transistors 131, 133, 137, and 139. Transistors 131 and 133 are in a current mirror configuration and transistors 137 and 139 are in a current mirror configuration. In the embodiment shown, transistor 133 is sized to provide ten times the current as transistor 129 (as indicated by the "10" next to transistor 133). Because transistors 137 and 139 are the same size, stage 120 provides ten times the current received at node 122 (IREF or 3×IREF depending upon the assertion of the FINE TRIM signal) at node 132 when activated or enabled.

Stage 120 includes a mirror activation circuitry that is responsive to the RANGE1 signal to activate the current mirror circuitry to provide a mirrored current that is multiplied by 10 at node 132. The activation circuitry includes NFET 127 that becomes conductive in response to an asserted RANGE1 signal and PFET 125, NFET 134, and PFET 138 that are conductive when the RANGE1 signal is not asserted. When the RANGE1 signal is asserted, transistor 127 is conductive to enable current to flow in the current path from the VDD terminal, through transistor 121, node 122, transistor 127, and transistor 131 wherein a voltage is applied at the gates of transistors 131 and 133 such that a current 10 times greater than the current flowing through node 122 flows through transistors 137 and 139. Because transistors 137 and 139 are in a mirror configuration and are of the same size, 10 times the current flowing through node 122 flows through node 132.

When the RANGE1 signal is not asserted, PFET 125 is conductive such that current from transistor 121 and node 122 flows through transistor 125 to node 132. Also, when the RANGE1 signal is not asserted, transistor 127 is nonconductive such that no current should flow through transistor 131. Accordingly, the voltage at the gates of transistors 131 and 133 should not be sufficient to make those transistors conductive. However, in some instances due to temperature, voltage, and process variation, a sufficient amount of leakage current may flow through transistor 127 to undesirably pull the voltage of the gates of transistors 131 and 133 above the threshold voltage of those transistors, thereby causing them to conduct, which would undesirably produce a mirrored current at node 132. Accordingly, stage 120 includes an inverter 136 that receives the RANGE1 signal and transistor 134 that is conductive when the RANGE1 signal is not asserted to pull the voltage of the gates of transistors 131 and 133 to ground such that they remain nonconductive even if a sufficient leakage current flows through transistor 127.

With transistor 133 being nonconductive, no current should flow through the current path of transistor 137 and transistor 139 such that a voltage on the gates of transistors 137 and 139 should not be pulled sufficiently low to make transistor 139 conductive. However, in some instances due to temperature, voltage, and process variation, a sufficient amount of leakage current may flow through transistor 133 to undesirably pull the voltage of the gates of transistors 137 and 139 below the threshold voltage of those transistors, thereby causing them to conduct, which would undesirably produce a mirrored current at node 132. Accordingly, stage 120 includes a PFET 138 that receives the RANGE1 signal and is conductive when the RANGE1 signal is not asserted to pull the voltage of the gates of transistors 137 and 139 to VDD such that they remain nonconductive even if a sufficient leakage current flows through transistor 133. Thus, no current should flow through transistor 139 to node 132 when the RANGE1 signal is not asserted.

Accordingly, when the RANGE1 signal is asserted, current mirror stage 120 provides a mirrored current from transistor 139 to node 132 at a multiple (which is 10 in the embodiment shown) of the input current to node 122. When the RANGE1 signal is not asserted, current mirror stage 120 provides the current from the input (node 122) to the output node 132 and the current mirror circuitry is disabled where it does not provide a mirrored current from transistor 139 to node 132.

One advantage of providing a current mirror stage where the input current can be provided to the output (e.g. via transistor 125) and the current mirror circuitry (e.g. transistors 131, 133, 137, and 139) is disabled is that the current paths between the power supply terminals (e.g. VDD, Ground) can be turned off when the stage is not providing mirrored current. Accordingly, current consumption can be significantly reduced in that the current mirror circuitry of a stage is not being used when the stage is not selected for multiplication.

In the embodiment of FIG. 1, stages 130 and 140 are similar to stage 120. When the current mirror circuitry of either of those stages is activated by the asserted range signal (RANGE2, RANGE3), the stage multiplies its input current by 10. When the stage is disabled, the input current of the stage is passed through to the output of the stage. In other embodiments, portion 105 may include an additional number of current mirror stages (not shown) daisy chained after stage 140.

FIG. 3 shows the amount of current provided at IOUT with respect to the number of range signals asserted (assuming portion 105 has only 3 current stages (120, 130, and 140) and the FINE TRIM signal is not asserted). If all three range signals are de-asserted, then current IREF is supplied at the output in that all of the current mirror circuitry of the three stages are turned off and there is a path from node 122, through conductive transistor 125, through node 132, and through node 142 to terminal IOUT (see FIG. 1). If one range signal is asserted (e.g. RANGE1 as shown in FIG. 3), then a current of 10×IREF is supplied at IOUT. If two range signals (e.g. RANGE1 and RANGE2 as shown in FIG. 3) are asserted, then a current of 100×IREF is supplied at IOUT. If all three range signals are asserted, then a current of 1000×IREF is supplied at IOUT in that all current mirror circuitry of the stages are enabled to perform the full multiplying capability of the coarse portion 105. If the FINE TRIM signal is asserted, then IOUT would be capable of providing 3×IREF, 30×IREF, 300×IREF, or 3000×IREF, depending upon the values of the range signals.

Although the current mirror circuitry of the current mirror stages 120, 130, and 140 of coarse portion 105 of FIG. 1 all have the same multiplying factor (times 10), in other embodiments, the current mirror stages may have other multiplying factors (e.g. 2, 3, 5, 100) including non integer multiplying factors (e.g. 2.5, 7.5) and fractional multiplying factors (e.g. 0.5, 0.25). In some embodiments, each stage may have a different multiplying factor to provide for the ability to have a different number of current values.

Figure 2:
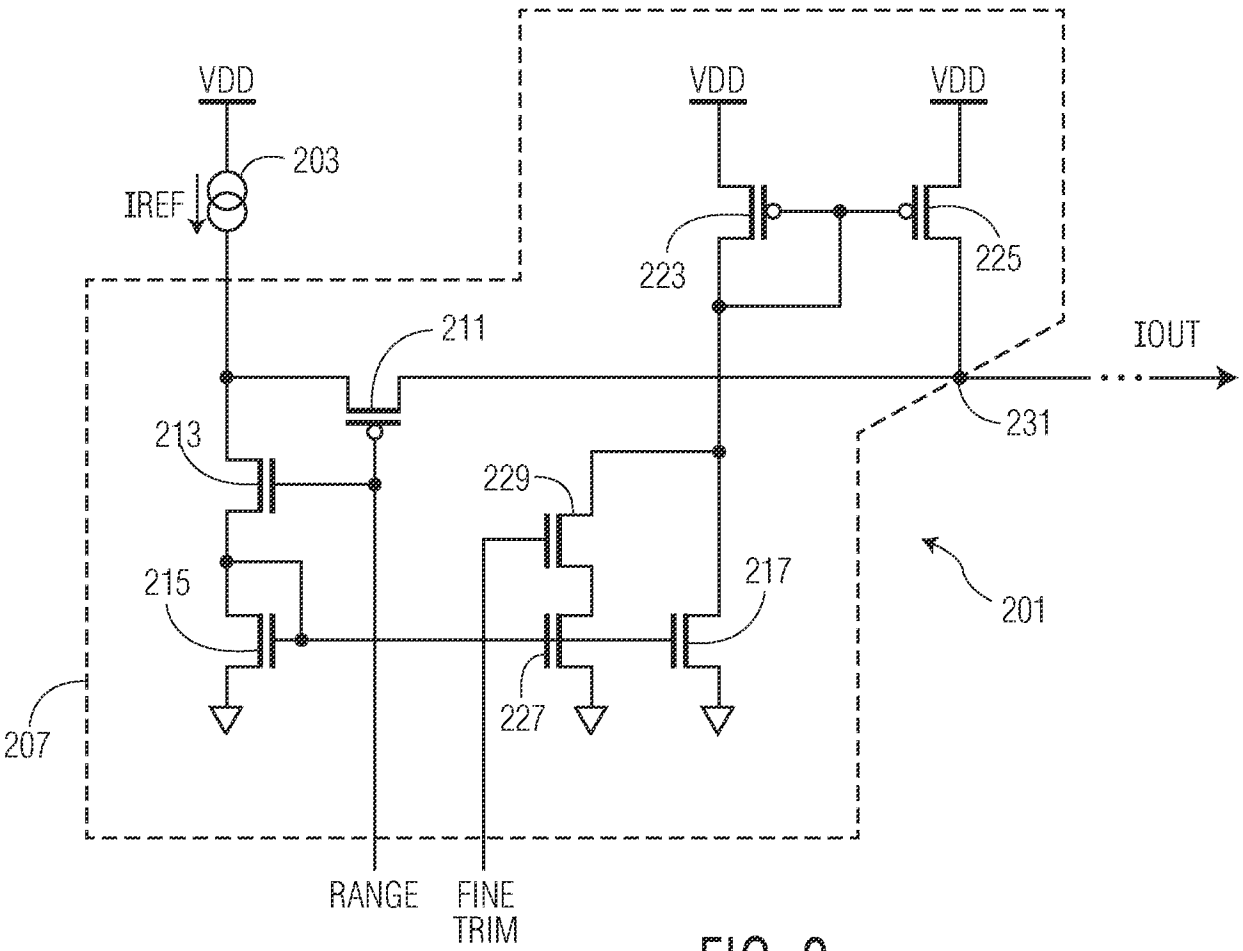
FIG. 2 is a circuit diagram of a current generation circuit according to another embodiment of the present invention.

FIG. 2 is a circuit diagram of a current generation circuit according to another embodiment. Current generation circuit 201 includes a current source 203 that provides a current IREF. Circuit 201 includes an initial current mirror stage 207 that includes transistors 215 and 217 configured in a current mirror configuration and transistors 223 and 225 configured in a current mirror configuration for providing a mirrored current of IREF at node 231 when enabled. Transistors 215, 217, 223, and 225 are sized to provide a multiplying factor (e.g. 2, 5, 10) to the mirrored current provided at node 231.

Stage 207 includes transistors 213 and 217 that are controlled by the RANGE signal. When the RANGE signal is asserted, transistor 213 is conductive and transistor 211 is nonconductive such that current from current source 203 flows through a conductive transistor 213 and through transistor 215 to enable transistors 215, 217, 223, and 225 to provide at mirrored current at node 231. When the RANGE signal is not asserted, transistor 211 is conductive and transistor 213 is nonconductive such that the current from current source 203 flows through transistor 211 to node 231 and the current mirror circuitry is disabled.

Stage 207 also includes a trim circuit of transistors 229 and 227 that when enabled by the FINE TRIM signal when the RANGE signal is asserted, act to adjust the multiplication factor of the current mirror circuitry by increasing the amount of current through transistors 223 and 225. In other embodiments, stage 207 may include latching transistors (not shown) similar to transistors 134 and 138 of FIG. 1 for pulling the gates of transistors 215 and 217 to ground and for pulling the gates of transistors 223 and 225 to VDD when the RANGE signal is not asserted.

Circuit 201 may include additional current mirror stages (not shown) daisy chained to node 231 for selectively providing further multiplication of the IREF current. These additional current mirror stages may have other multiplying factors (e.g. 10). In some embodiments, at least some of the other current mirror stages may include trim circuitry as well.

In some embodiments, providing switches (e.g. transistors 211 and 213) in the initial current stage, may reduce the number of current mirror stages of a current generation circuit. In some embodiments, IOUT may be provided to a final current mirror stage (not shown) that is sized to provide an appropriate amount of drive current for a circuit that utilizes current generator circuit 201.

Figure 4:
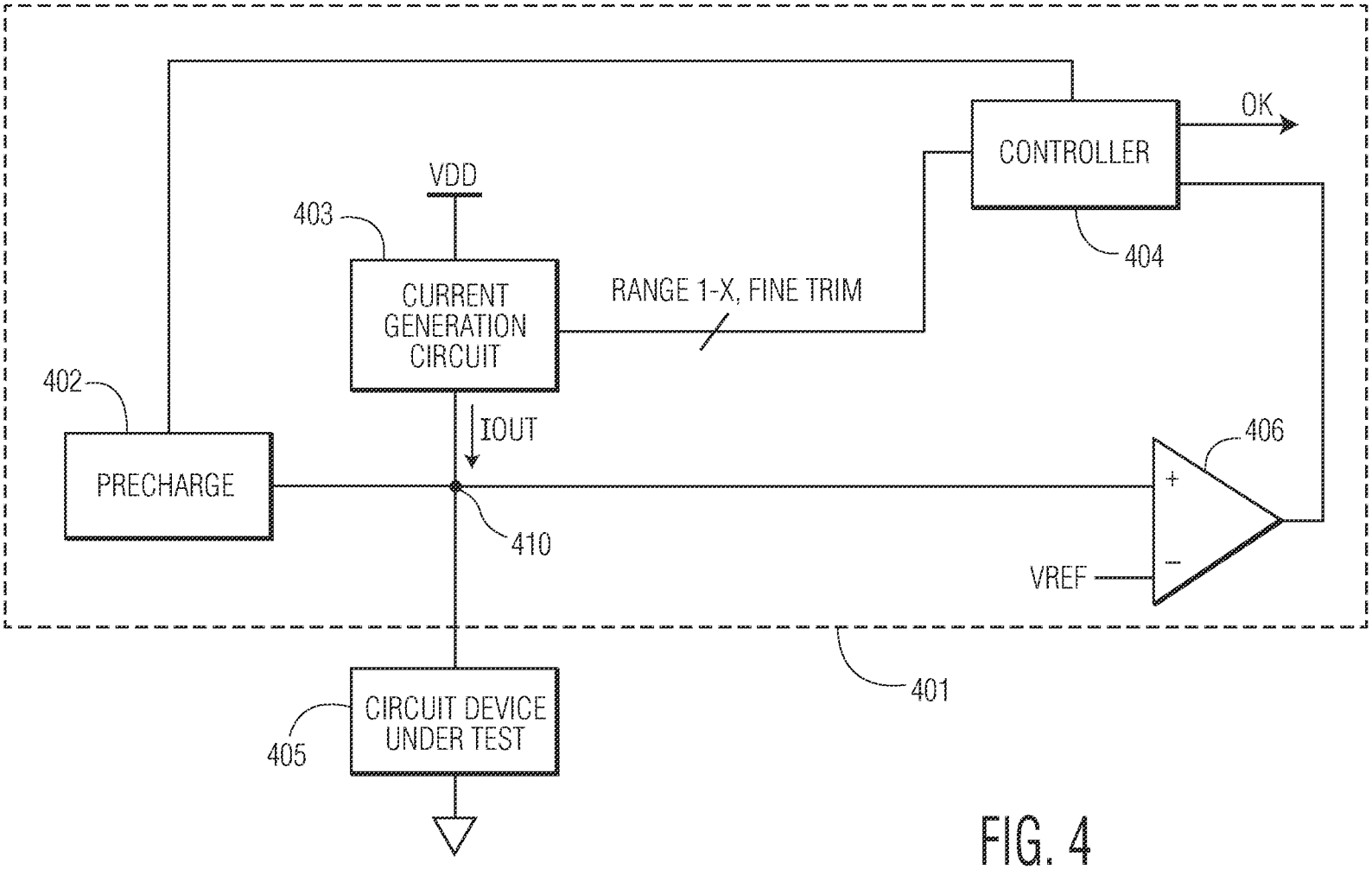
FIG. 4 is a circuit diagram of a testing circuit according to one embodiment of the present invention.

FIG. 4 is a circuit diagram of a test circuit according to one embodiment of the present invention. Test circuit 401 is used to test circuit device 405. In one embodiment, a circuit device 405 is single device such as a transistor but may include multiple devices configured in a circuit. In one embodiment, circuit device 405 is on the same integrated circuit as circuit 401, but in other embodiments, they may be implemented on different integrated circuits. In some embodiments, circuit 401 may perform a built-in self-test on circuit device 405. The test may be performed at various times e.g. during manufacture, during postproduction testing, during start up, and/or during operation.

Test circuit 401 includes current generation circuit 403 for providing a variable test current IOUT at node 410. In some embodiments, current generation circuit 403 is similar to circuit 101 or circuit 201. Circuit 401 includes a comparator 406 that compares the voltage of node 410 to a reference voltage (VREF) a provides a signal to controller 404 that indicates whether node 410 is at a higher voltage than VREF or not. In some embodiments, VREF may be variable and controlled by controller 404. Circuit 402 includes a precharge circuit 402 for precharging node 410 to a specified voltage e.g. at VREF or slightly below VREF to speed up the results of the test.

In one embodiment during a test, controller 403 sets the RANGE signals (RANGE1-X) and the FINE TRIM signal to control the amount of current flowing through node 410. In some embodiments, these signals are sent as part of a thermometer code. In some embodiments, the current is initially set at a low value and then increased until the voltage at node 410 falls below VREF indicating a point where circuit device 405 is in a current breakdown. In other embodiments, the current may be set at a high value and lowered until the voltage rises above VREF. In some embodiments, test circuit 401 can be used to detect soft or hard defects that can cause leakages and later functional failures in the circuitry. These tests can be run as part of leakage current measurements or scan testing.

In some embodiments, controller 404 may enable a succession of current mirror stages (e.g. 120, 130, and 140) so as to raise the current by multiples (e.g. 10, 100, 1000) to quickly determine a range in which the circuit device can no longer operate properly. In some embodiments, after the coarse current range of such a point is determined, the FINE TRIM signal may be asserted to more closely determine the current amount where the output of comparator 406 flipped. Controller 404 includes an output (labeled OK) indicating that the circuit device 405 is operable within specified parameters based on the test results. In some embodiments, circuit 403 may be programmed to provide the highest current first and then lower the current as the test progresses. Other test circuits may perform other tests and/or have other configurations in other embodiments.

One advantage of using the current generation circuit with daisy chained current mirror stages is that the current generation circuit can be controlled to provide current over a logarithmic range due to the multiplication of the input currents by each stage. Accordingly, a test may be performed more rapidly over a wider range of current amounts.

In the embodiments shown, the current mirror circuitry and switches are implemented with CMOS transistors. However, in other embodiments, the current mirror circuitry and switches may be implemented with other types of transistors (e.g. bipolar transistors). Also, the switches (e.g. transistors 125, 127, and 113) may be implemented with other types of switches such as pass gates.

In the embodiment shown in FIG. 1, the current received by the input (node 122) of stage 120 is provided flowing into node 122 from a VDD terminal through transistor 121. However, in other configurations, current may be "received" by an input by current flowing from an input node connected to a PFET to ground. For example, in some embodiments, the current source (e.g. IREF 107) may be located below a PFET (not shown) of a current mirror of a current input stage where the drain of the PFET is the input to the current mirror stage. Also, in the embodiment of FIG. 1, current is provided by output node 132 by current flowing out from node 132 from a VDD terminal through transistor 139. However, in other embodiments, current may be "provided" by an output of a stage where current is flowing into the output node (132) from a ground terminal.

A gate is a control electrode for a field effect transistor (FET). A source and a drain are current electrodes for a FET.

Structures or features described herein with respect to one embodiment may be implemented with other embodiments described herein.

In one embodiment, a circuit includes a current mirror stage. The current mirror stage includes an input to receive an input current, an output to provide an output current, current mirror circuitry, and a switch. When the switch is conductive during operation, current flows between the input and output through the switch and when the switch is not conductive during operation, current does not flow between the input and output and the current mirror circuitry provides a current to the output that is mirrored from a current received by the input.

In another embodiment, a method includes operating a current mirror stage with a switch of the current mirror stage being conductive where current flows between an input of the current mirror stage and an output of the current mirror stage through the switch and current mirror circuitry of the current mirror stage does not provide a current to the output that is mirrored from a current provided to the input. The method includes operating the current mirror stage with the switch being nonconductive where current does not flow between the input and the output through the switch and the current mirror circuitry of the current mirror stage provides a current to the output that is mirrored from a current provided to the input.

While particular embodiments of the present invention have been shown and described, it will be recognized to those skilled in the art that, based upon the teachings herein, further changes and modifications may be made without departing from this invention and its broader aspects, and thus, the appended claims are to encompass within their scope all such changes and modifications as are within the true spirit and scope of this invention.

What is claimed is:

1. A circuit comprising:

a current mirror stage, the current mirror stage including:

an input to receive an input current;

an output to provide an output current;

current mirror circuitry;

a switch, wherein when the switch is conductive during operation, current flows between the input and output through the switch and when the switch is not conductive during operation, current does not flow between the input and output and the current mirror circuitry provides a current to the output that is mirrored from a current received by the input;

wherein when the switch is conductive during operation, the current mirror circuitry does not provide a current to the output that is mirrored from the current received by the input.

2. The circuit of claim 1 further comprising:

a second switch;

wherein the current mirror circuitry includes a first current path coupled to the input, the second switch is located in the first current path, wherein when the switch is conductive during operation, the second switch is nonconductive to prevent current from flowing through the first current path to disable the current mirror circuitry from providing a mirrored current to the output.

3. The circuit of claim 2 wherein when the switch is nonconductive during operation, the second switch is conductive for the current mirror circuitry to provide a mirrored current at the output of the current mirror stage.

4. The circuit of claim 1 further comprising:

a second current mirror stage, the current mirror stage including:

a second input to receive an input current from the output of the current mirror stage;

a second output to provide an output current;

second current mirror circuitry;

a second switch, wherein when the second switch is conductive during operation, current flows between the second input and second output through the second switch and when the second switch is nonconductive during operation, current does not flow between the second input and the second output and the second current mirror circuitry provides a current to the second output that is mirrored from a current received at the second input.

5. The circuit of claim 4 further comprising:

a controller, the controller including a first output to control the switch of the current mirror stage and a second output to control the second switch of the second current mirror stage.

6. The circuit of claim 1 wherein the current mirror circuitry provides mirrored current at a multiple other than one of the current received at the input of the current mirror stage.

7. The circuit of claim 1 wherein the current mirror circuitry includes:

a first current path coupled to the input and including a first transistor of a first conductivity type:

a second current path including a second transistor of the first conductivity type and a third transistor of a second conductivity type;

a third current path coupled to the output and including a fourth transistor of the second conductivity type;

wherein the third transistor and the fourth transistor are in a mirror configuration;

wherein the first transistor and the second transistor are in a current mirror configuration.

8. The circuit of claim 7, wherein the current mirror stage includes:

a fifth transistor that pulls control electrodes of the first transistor and the second transistor to a first voltage terminal which makes the first transistor and the second transistor nonconductive when the switch is conductive; and a sixth transistor that pulls control electrodes of the third transistor and the fourth transistor to a second voltage terminal which makes the third transistor and the fourth transistor nonconductive when the switch is conductive.

9. The circuit of claim 1, wherein the current mirror stage further comprises:

a trim current path coupled to a current path of the current mirror circuitry, the trim current path includes a second switch, that when made conductive, adjusts the current through the current path to adjust a multiplying factor of the current mirror circuitry.

10. The circuit of claim 1 further comprising:

an initial current mirror stage, including:

current mirror circuitry:

a trim current path coupled to a current path of the current mirror circuitry of the initial current mirror stage, the trim current path includes a second switch, that when made conductive, adjusts the current through the current path to adjust a multiplying factor of the current mirror circuitry.

11. The circuit of claim 1 further comprising:

a current generation circuit for generating first current, the current generation circuit including the current mirror stage;

an output node for providing the first current;

a controller;

a voltage detection circuit for measuring a voltage of the output node and providing an indication of the measured voltage to the controller;

wherein the controller providing a control signal to the current generation circuit to control an amount of the first current provided at the output.

12. The circuit of claim 11 wherein the controller provides an indication of whether a circuit device coupled to receive current from the output node is operable within specified parameters.

13. A method comprising:

operating a current mirror stage with a switch of the current mirror stage being conductive where current flows between an input of the current mirror stage and an output of the current mirror stage through the switch and current mirror circuitry of the current mirror stage does not provide a current to the output that is mirrored from a current provided to the input;

operating the current mirror stage with the switch being nonconductive where current does not flow between the input and the output through the switch and the current mirror circuitry of the current mirror stage provides a current to the output that is mirrored from a current provided to the input.

14. The method of claim 13 wherein when operating with the switch being conductive, an amount of current provided at the output is equal to an amount of current provided at the input, wherein when operating with the switch being nonconductive, the amount of current provided at the output is not equal to the amount of current provided at the input.

15. The method of claim 13 further comprising:

operating a second current mirror stage with a second switch of the second current mirror stage being conductive where current flows between an input of the second current mirror stage and an output of the second current mirror stage through the second switch;

operating the second current mirror stage with the second switch being nonconductive where current does not flow between the input and the output of the second current mirror stage through the second switch and second current mirror circuitry of the second current mirror stage provides a current to the output of the second current mirror stage that is mirrored from a current provided to the input of the second current mirror stage;

wherein the input of the second current mirror stage is coupled to the output of the current mirror stage.

16. The method of claim 15 further comprising:

wherein for at least a portion of a time, the current mirror stage operates with the switch being nonconductive concurrently with the second current mirror stage operating with the second switch being conductive.

17. The method of claim 13 wherein the current mirror stage is part of a current generation circuit that provides a first current, wherein the first current is at a first amount during the operating the current mirror stage with the switch of the current mirror stage being conductive and the first current is at a different amount during the operating the current mirror stage with the switch of the current mirror stage being nonconductive.

18. The method of claim 17 wherein the first current is provided to a circuit device being tested to determine if the circuit device is operable within design parameters.

19. The method of claim 18 wherein the operating the current mirror stage with the switch of the current mirror stage being conductive is changed to the operating the current mirror stage with the switch of the current mirror stage being nonconductive during a testing of the circuit device to increase an amount of the first current provided to the circuit device.

* * * * *